US012018700B2

(12) United States Patent
Sun et al.

(10) Patent No.: US 12,018,700 B2
(45) Date of Patent: Jun. 25, 2024

(54) ACOUSTIC CUTOFF BASED NOISE REDUCTION DEVICE FOR HEAT DISSIPATION FANS, AND MANUFACTURING METHOD THEREOF

(71) Applicants: SHANGHAI JIAO TONG UNIVERSITY, Shanghai (CN); SJTU TURBO-FAN TECHNOLOGY CO., LTD., Shanghai (CN)

(72) Inventors: Zonghan Sun, Shanghai (CN); Jie Tian, Shanghai (CN); Hua Ouyang, Shanghai (CN)

(73) Assignees: SHANGHAI JIAO TONG UNIVERSITY, Shanghai (CN); SITU TURBO-FAN TECHNOLOGY CO., LTD., Shanghai (CN)

( * ) Notice: Subject to any disclaimer, the term of this patent is extended or adjusted under 35 U.S.C. 154(b) by 183 days.

(21) Appl. No.: 17/501,220

(22) Filed: Oct. 14, 2021

(65) Prior Publication Data

US 2022/0082112 A1 Mar. 17, 2022

Related U.S. Application Data

(63) Continuation-in-part of application No. PCT/CN2019/122890, filed on Dec. 4, 2019.

(30) Foreign Application Priority Data

Apr. 15, 2019 (CN) ..... 201910300235.5

(51) Int. Cl.
*F04D 29/66* (2006.01)
*F04D 29/54* (2006.01)

(52) U.S. Cl.
CPC ..... *F04D 29/663* (2013.01); *F04D 29/541* (2013.01)

(58) Field of Classification Search
CPC ..... F04D 29/663; F04D 29/664; F04D 29/541
See application file for complete search history.

(56) References Cited

U.S. PATENT DOCUMENTS 11,168,696 B2 * 11/2021 Myers McCarthy ..... F04D 29/665
2012/0301329 A1 11/2012 Bilodeau et al.
2018/0202464 A1 * 7/2018 Soutar ..... F04D 29/664

FOREIGN PATENT DOCUMENTS

CN 201723504 U 1/2011
CN 103717908 A * 4/2014 ..... F01P 5/06
(Continued)

OTHER PUBLICATIONS

PCT; App No. PCT/CN2019/122890; International Search Report and Written Opinion dated Mar. 2, 2020.
(Continued)

*Primary Examiner* — Sabbir Hasan
(74) *Attorney, Agent, or Firm* — Fitch, Even, Tabin & Flannery, LLP

(57) ABSTRACT

Disclosed is a noise reduction device for heat dissipation fans, the noise reduction device being applied to a heat dissipation fan with an interference structure for rotor and stator blades, wherein the noise reduction device comprises a duct formed at an end portion of a through-flow area of the heat dissipation fan, the inner diameter D of the duct is determined by the size and the rotation speed of the heat dissipation fan, and the axial length L of the duct is determined by an acoustic cutoff condition of the heat dissipation fan.

15 Claims, 7 Drawing Sheets

(56) References Cited

FOREIGN PATENT DOCUMENTS

| | | | |
|---|---|---|---|
| CN | 103717908 | A | 4/2014 |
| CN | 106321520 | A | 1/2017 |
| CN | 207647855 | U | 7/2018 |
| CN | 109882452 | A | 6/2019 |
| EP | 3530961 | A1 | 8/2019 |
| WO | 2002038962 | A2 | 5/2002 |

OTHER PUBLICATIONS

Sun, Zonghan, et al. "Aerodynamic noise control technology of electronic device cooling fan based on duct acoustic mode cutoff." Journal of Applied Acoustics 39.2: 189-198, English abstract.

Sun, Zonghan, et al. "Noise Reduction Analysis of Electronic Device Cooling Fan With Duct and Its Application Under Variable Working Conditions." Turbo Expo: Power for Land, Sea, and Air. vol. 84928. American Society of Mechanical Engineers, 2021.

Sun Zonghan, et al. "Azimuthal Mode Experiment of Aerodynamic Noise of Axial Flow Fan for Electronic Device Heat Dissipation". Journal of Mechanical Engineering, 2020, 56(18): 164-171, English abstract.

* cited by examiner

ACOUSTIC CUTOFF BASED NOISE REDUCTION DEVICE FOR HEAT DISSIPATION FANS, AND MANUFACTURING METHOD THEREOF

FIELD OF THE INVENTION

This application relates to the technical field of noise reduction, and in particular to an acoustic cutoff based noise reduction device for heat dissipation fans, and a manufacturing method thereof.

DESCRIPTION OF THE PRIOR ART

At present, heat dissipation fans with interference structures for rotor and stator blades are widely used in computer servers and communication router cabinets. Due to the tight arrangement of electronic devices in the cabinet and serious heat generation, it is often necessary to connect multiple variable-speed axial flow heat dissipation fans in parallel to form a heat dissipation unit to dissipate heat, thus ensuring normal operation of the equipment. In order to meet air volume requirements, this type of heat dissipation fan often rotates at a high speed. However, the high-speed operation of multiple fans results in high aerodynamic noise, which brings great troubles to people, especially in a server room where multiple cabinets are centrally placed, the noise is even more unbearable.

The aerodynamic noise of the heat dissipation fan is mainly discrete single-tone noise of a blade passing frequency and its multiplier frequencies. In order to reduce fan noise, a common way is to improve the appearance and contour supported by fan rotor blades and upstream and downstream stator blades, so as to achieve an effect of suppressing noise. But after years of trying such improvements, there is not much room for improvement. In addition, improvements in shapes such as blade trailing edge serrations and blade openings will also bring about problems such as increased manufacturing difficulty and increased cost.

Therefore, how to achieve further noise reduction in a limited space without greatly affecting the performance of the fan is an urgent problem to be solved. A common fan with an interference structure for rotor and stator blades, which is similar to a heat dissipation fan, may result in axial propagation of rotating circumferential acoustic modes.

Accordingly, those skilled in the art devote themselves to developing a device and method that can suppress the aerodynamic noise of the heat dissipation fan from the circumferential mode propagation of noise.

SUMMARY OF THE INVENTION

In view of the above-mentioned shortcomings of the prior art, the technical problem to be solved by this application is to effectively inhibit circumferential mode propagation off an aerodynamic noise based on duct acoustic cutoff on the premise that the influence on the performance of a heat dissipation fan is as small as possible, so as to achieve a noise reduction effect.

To achieve the above purpose, this application provides a noise reduction device for heat dissipation fans, the noise reduction device being applied to a heat dissipation fan with an interference structure for rotor and stator blades, wherein the noise reduction device comprises a duct formed at an end portion of a through-flow area of the heat dissipation fan, the inner diameter D of the duct is determined by the size and the rotation speed of the heat dissipation fan, and the axial length L of the duct is determined by an acoustic cutoff condition of the heat dissipation fan.

Further, the inner diameter D of the duct is greater than or equal to the diameter of the through-flow area of the heat dissipation fan, and the inner diameter D of the duct is less than or equal to the outer frame size of the heat dissipation fan.

Further, the axial length L and the inner diameter D of the duct satisfy $0.08 \leq L/D \leq 0.48$.

Further, the duct is a flow guide cover in a cylindrical shape, one end of the flow guide cover is connected to a fixing bracket, and the fixing bracket is connected to the outer frame of the heat dissipation fan.

Further, the inner wall of the flow guide cover is smooth.

Further, the inner wall of the flow guide cover is provided with a microporous structure.

Further, the pore size and porosity of the microporous structure are determined by the noise frequency of the heat dissipation fan.

Further, the pore size of the microporous structure is no more than 1 mm, and the porosity is 1%-3%.

Further, the inner wall of the flow guide cover is provided with a recessed structure.

Further, the recessed structure is a partially ellipsoid shape formed by hollowing out the inner wall.

Further, a horn-shaped air inlet is provided at an end portion of the flow guide cover far away from the fixing bracket.

Further, the horn-shaped air inlet and the flow guide cover are formed integrally.

Further, the horn-shaped air inlet and the flow guide cover are spliced in a split manner, and the splicing place is flat and smooth.

Further, the noise reduction device is formed from a cylindrical structure which is formed by extending a flow channel end wall provided inside the outer frame of the heat dissipation fan outwards, the distance of the cylindrical structure beyond the blades of the heat dissipation fan is L, and the inner diameter of the cylindrical structure is D, where $0.08 \leq L/D \leq 0.48$.

Further, an end portion of the cylindrical structure is provided with a horn mouth.

Further, the outer frame is a regular hexagon.

Further, the inner wall of the horn mouth is provided with a recessed structure.

This application also provides a method for manufacturing a noise reduction device for heat dissipation fans, comprising the following step:

manufacturing a duct structure according to the appearance of a heat dissipation fan, wherein the inner diameter of the duct structure is determined by the size and the rotation speed of the heat dissipation fan, and the axial length of the duct structure is determined by an acoustic cutoff condition.

Further, the duct structure is a flow guide cover in a cylindrical shape, and the flow guide cover is formed integrally with a fixing bracket and then is connected to the outer frame of the heat dissipation fan.

Further, the duct structure is formed by extending a flow channel end wall inside the outer frame of the heat dissipation fan outwards.

Compared with the prior art, in a limited space of a cabinet, on the premise that it is suitable for installation and has little influence on the air volume of the heat dissipation fan, the axial propagation of circumferential acoustic modes for the aerodynamic noise generated by the heat dissipation fan can be inhibited in this application. The device installed at the upstream of the heat dissipation fan can also correct inlet incoming flow deformation of the heat dissipation fan, thereby reducing the discrete single-tone noise generated by the heat dissipation fan.

The concept, specific structures, and technical effects of this application will be further described below in conjunction with accompanying drawings, such that the purpose, features, and effects of this application can be fully understood.

Figure 1:
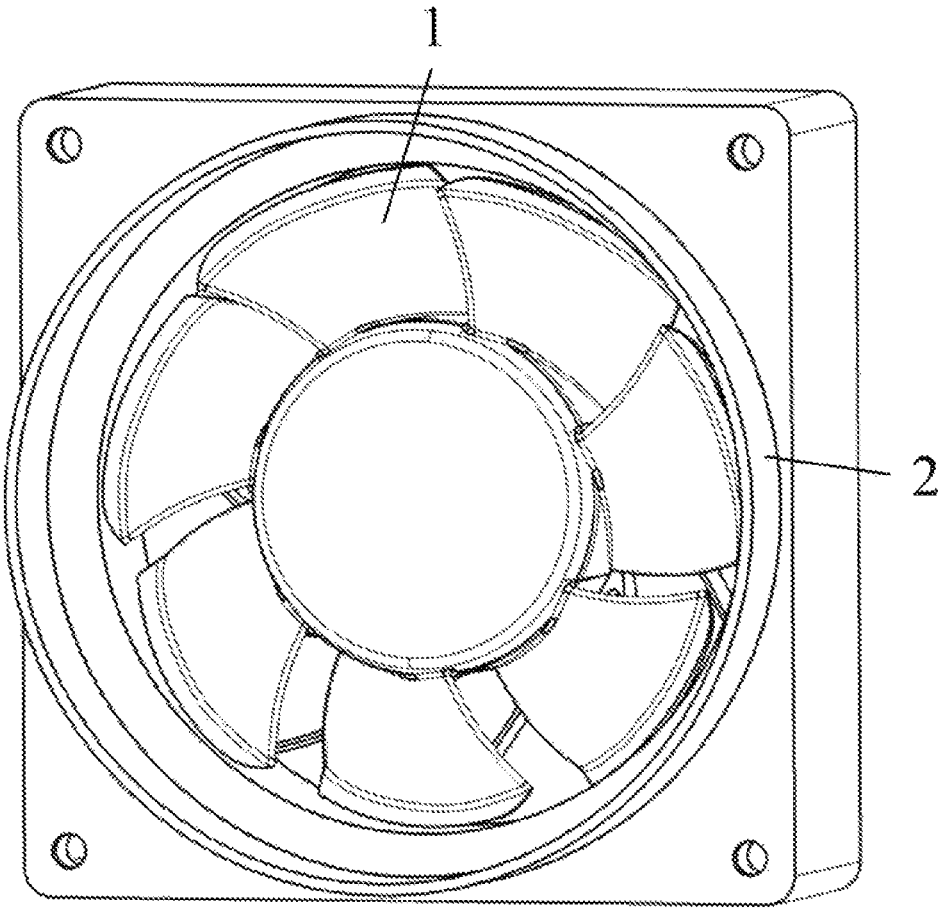
FIG. 1 is a schematic view of the installation of a noise reduction device of this application.
Figure 2:
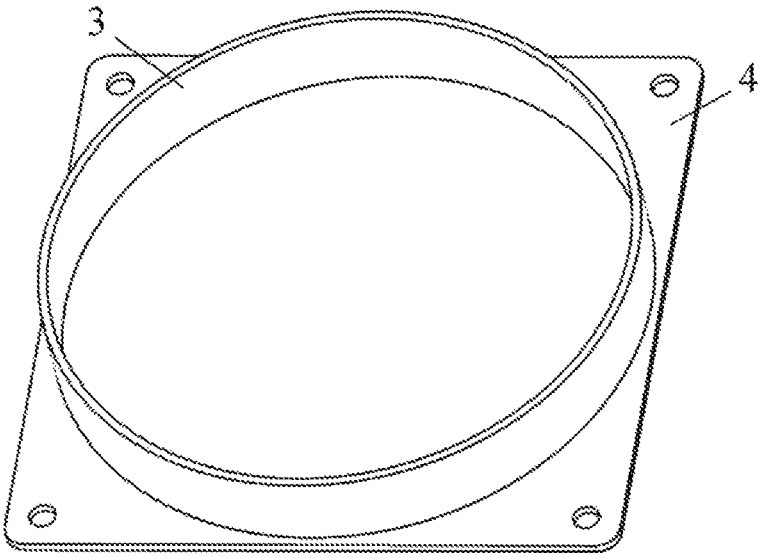
FIG. 2 is a schematic view of a three-dimensional structure of a noise reduction device of this application.
Figure 3:
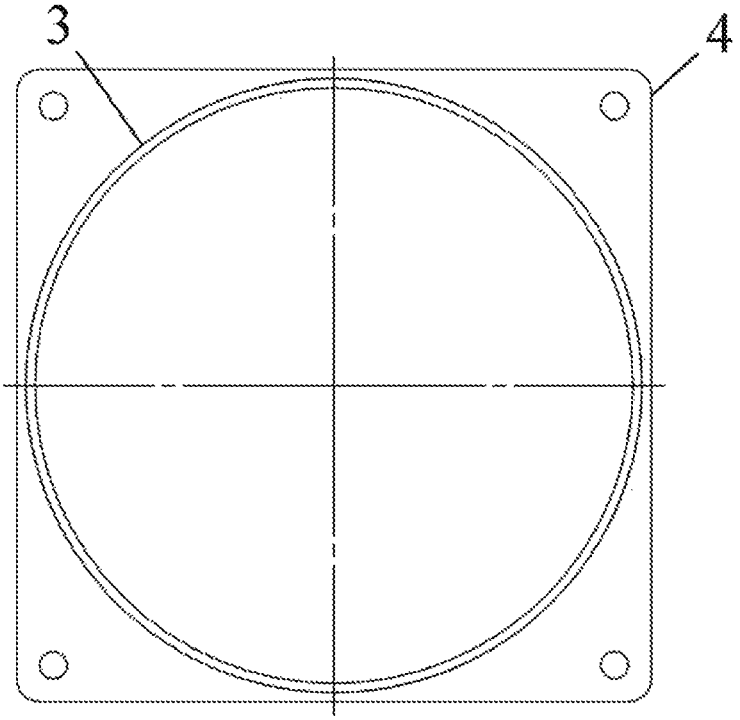
FIG. 3 is a top view of a noise reduction device of this application.
Figure 4:
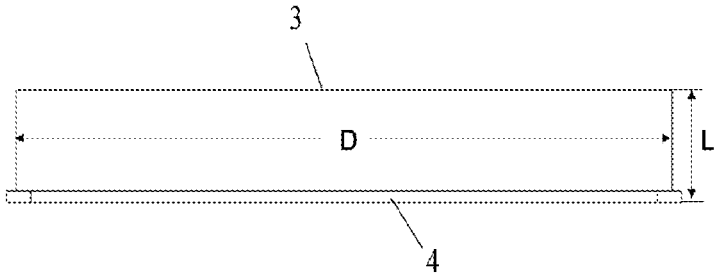
FIG. 4 is a side view of a noise reduction device of this application.

In the figures: 1—heat dissipation fan, 2—noise reduction device, 3—short tube flow guide cover, 31—microporous structure, 32—horn-shaped air inlet, 4—fixing bracket, 41—sealing ring, 42—rubber pad, 5—outer frame of fan, 6—flow channel end wall, 7—fan blade, 8—horn mouth, 81—recessed structure.

DETAILED DESCRIPTION OF THE PREFERRED EMBODIMENTS

Preferred embodiments of this application will be introduced below with reference to the accompanying drawings of the specification, such that the technical content can be clearly and easily understood. This application can be embodied through embodiments of many different forms, and the protection scope of this application is not limited to the embodiments mentioned herein.

In the drawings, components with the same structure are denoted by the same numeral, and components with similar structures or functions are denoted by similar numerals. The size and thickness of each component are randomly shown in the drawings, and this application does not limit the size and thickness of each component. In order to make the illustration clearer, a thickness of a component is appropriately exaggerated in some places of the drawings.

This application provides a noise reduction device for suppressing the noise of a heat dissipation fan, which comprises a duct formed at an end portion of a through-flow area of the heat dissipation fan. The duct may be formed from an additional component added to the heat dissipation fan, or may be formed by modifying the outer frame of the heat dissipation fan. The inner diameter of the duct is determined by the size and the rotation speed of the heat dissipation fan, and the axial length is determined by an acoustic cutoff condition of the heat dissipation fan, such that the duct can inhibit the axial propagation of circumferential acoustic modes for the aerodynamic noise generated by the heat dissipation fan, and achieve the purpose of noise reduction.

Embodiment 1

As shown in FIGS. 1, 2, 3 and 4, a noise reduction device 2 in this embodiment comprises a short tube flow guide cover 3 and a fixing bracket 4, the short tube flow guide cover 3 is installed, by means of the fixing bracket 4, at the upstream of a through-flow area of a heat dissipation fan 1 with an interference structure for rotor and stator blades and is tightly fitted to the outer frame of the heat dissipation fan 1, wherein the inner diameter D of the short tube flow guide cover 3 is determined by the size and the rotation speed of the heat dissipation fan 1, and the axial length L of the short tube flow guide cover 3 is determined by an acoustic cutoff condition.

The short tube flow guide cover 3 is cylindrical and runs through from top to bottom, and has a certain diameter and wall thickness. For the heat dissipation fan 1 with an obvious interference structure for rotor and stator blades, it will generate circumferential acoustic modes regularly and propagate them into a free field in a rotating manner. The short tube flow guide cover 3 is equivalent to a section of duct, which has an obvious cutoff effect on this kind of rotating circumferential acoustic modes. The cutoff effect is directly related to the inner diameter D of the flow guide cover 3 and the rotation speed of the fan, and the cutoff result is related to the axial length L of the flow guide cover 3.

As shown in FIG. 1, the through-flow diameter of the heat dissipation fan 1 is 11.6 cm, and its rotation speed is 9000 rpm. On the premise of meeting performance requirements of the fan, that is, while ensuring that the inner diameter of the short tube flow guide cover 3 is $D \geq 11.6$ cm, the inner diameter and wall thickness of a specific short tube flow guide cover 3 should be determined according to the size and rotation speed of the heat dissipation fan 1 and the size limitation on the cabinet, and the ratio of the length L to the inner diameter D of the short tube flow guide cover 3 should meet the acoustic cutoff requirement. A structurally preferable solution is that the inner diameter D of the short tube flow guide cover 3 and the outer diameter of an inlet tapered section of the fan are same as 13 cm, thus ensuring that the inlet tapered section plays a rectifying role. In this case, for a heat dissipation fan with a subsonic blade tip speed, the circumferential acoustic modes that can be propagated is very limited.

Figure 11:
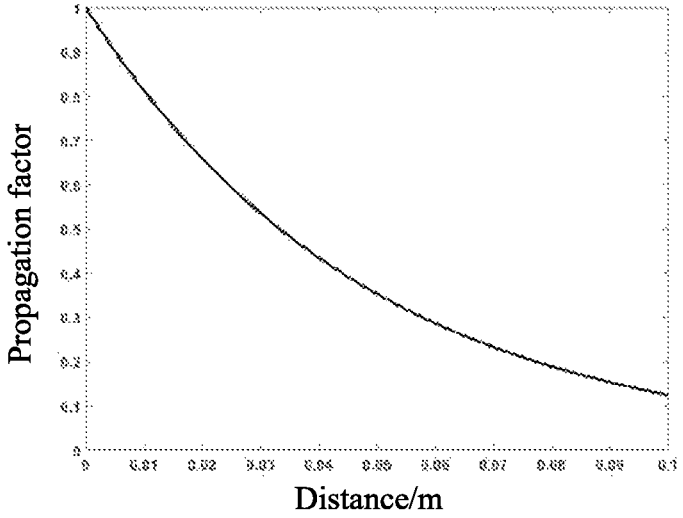
FIG. 11 is an exponential attenuation curve of mode waves corresponding to different harmonics of a blade passing frequency with respect to distance (harmonic number 1, circumferential mode number 1, and radial mode number 0)
Figure 12:
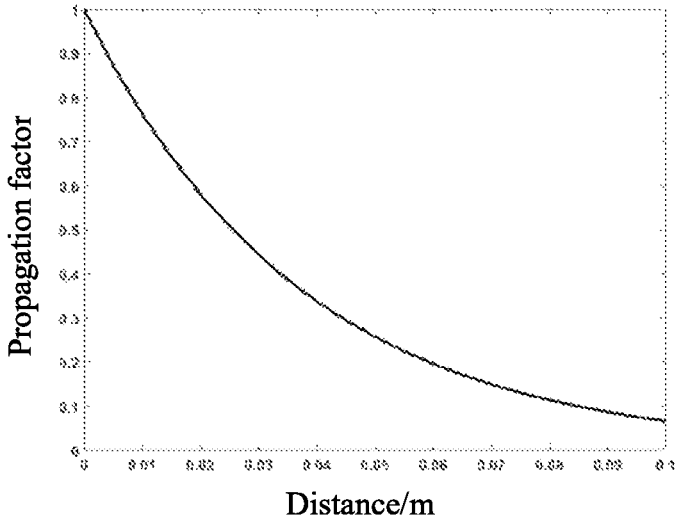
FIG. 12 is an exponential attenuation curve of mode waves corresponding to different harmonics of a blade passing frequency with respect to distance (harmonic number 2, circumferential mode number 2, and radial mode number 0)
Figure 13:
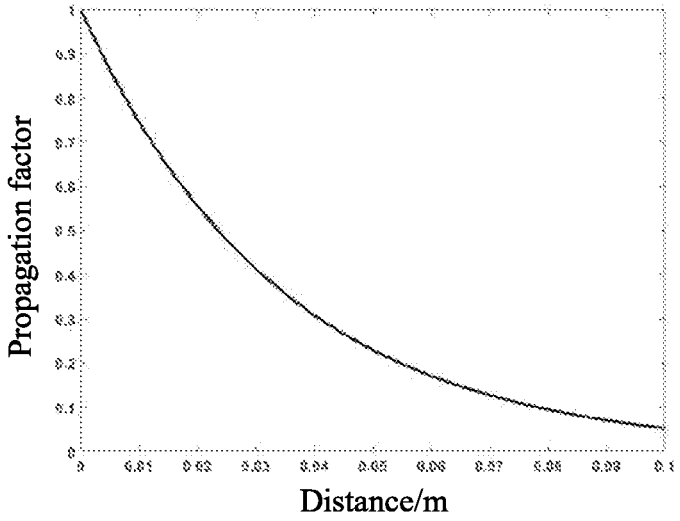
FIG. 13 is an exponential attenuation curve of mode waves corresponding to different harmonics of a blade passing frequency with respect to distance (harmonic number 3, circumferential mode number 3, and radial mode number 0).

According to the cutoff condition $$\Omega r_0 / c > \left|1 - \frac{p}{nB}\right|$$

for circumferential acoustic modes, where $\Omega$=942.48 rad/s is the rotation angular velocity of rotor blades, $r_0$=0.065 m is the tube wall radius, c=344 m/s is the sound speed, n=1, 2, 3, . . . is the number of harmonics of the blade passing frequency, and B=7 is the number of rotor blades, it can be derived that the number of circumferential acoustic modes satisfying the cutoff condition is |m|<n (n≤3) and these modes can be propagated along the duct, while modes that do not satisfy this condition are attenuated exponentially. Variation curves of the magnitude of a propagation factor $e^{(j\omega t - |k_{zmn}z|)}$ for mode waves at the cutoff edge with respect to distance are drawn, according to the attenuation law, as shown in FIGS. 11, 12 and 13, and these mode waves are attenuated the slowest. It can be seen that the mode waves that are attenuated the slowest have been attenuated by more than 50% in a distance range of 2 to 3 cm, and other mode waves are attenuated faster. A duct of 4 cm length is sufficient to block the propagation of most mode waves. In order to achieve the acoustic cutoff effect and minimize the influence on the fan performance, considering the space limitation on the heat dissipation fan 1, L/D can be selected as 0.08≤L/D≤0.48. If the length L of the short tube flow guide cover 3 is too long, not only the space occupied by the heat dissipation fan 1 is limited, but the air volume of the heat dissipation fan 1 may also be affected. When the duct lengthens and the pressure loss increases and the flow rate decreases, the performance of the heat dissipation fan 1 decreases. Experiments on a certain type of heat dissipation fan 1 in an anechoic room verified the noise reduction effect of the duct cutoff, and achieved an average noise level reduction of 2.5 dB (A) at 1 m in the far field with limited influence on the performance of the heat dissipation fan 1.

Figure 7:
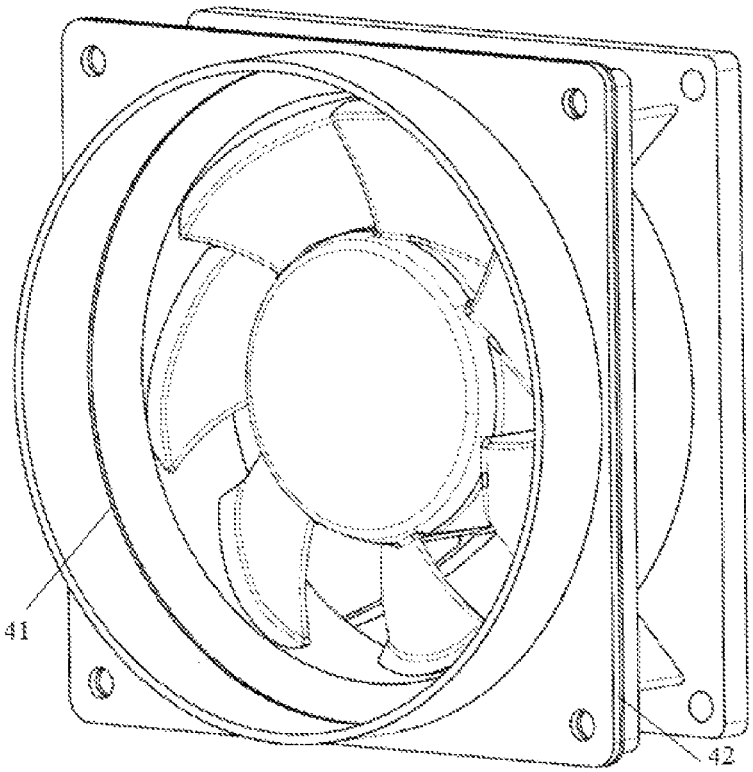
FIG. 7 is a schematic view of a rubber pad and a sealing ring of a noise reduction device of this application.

As shown in FIGS. 1, 2, 3 and 4, the fixing bracket 4 in this embodiment is selected into a square shape with round chamfers according to the appearance of the heat dissipation fan 1, and is integrally formed with the short tube flow guide cover 3. A fan with a square contour can be fixed in a tight fitting manner, and the fixing bracket 4 is connected to the outer frame of the heat dissipation fan 1 through fasteners (e.g. bolts). As shown in FIG. 7, a vibration isolation rubber pad 42 is installed between the fixing bracket 4 and the outer frame of the heat dissipation fan 1 to further reduce vibration, and the gap between the short tube flow guide cover 3 and the heat dissipation fan 1 is filled with a sealing ring 41 to ensure air tightness. It can be foreseen that if the appearance of the heat dissipation fan 1 is changed, the fixing bracket 4 of this application can be adjusted accordingly.

Specifically, when in use, a noise reduction device is firstly made according to the appearance of a fan with an interference structure for rotor and stator blades, wherein the inner diameter D of the short tube flow guide cover is determined by the size and the rotation speed of the fan, and the axial length L of the flow guide cover is determined by an acoustic cutoff condition; and then the noise reduction device is installed at the upstream and downstream of the through-flow area of the fan, and the short tube flow guide cover is tightly fitted to the fan with the fixing bracket.

Embodiment 2

Figure 5:
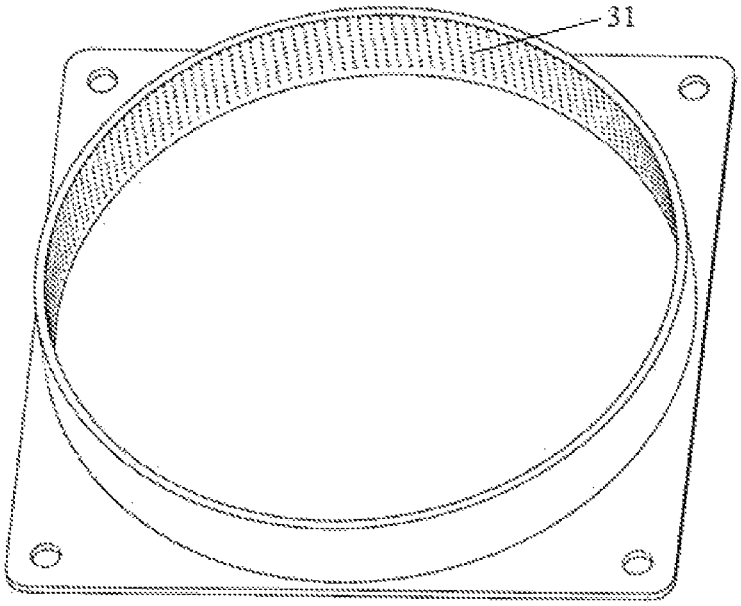
FIG. 5 is a schematic view of a microporous structure of a noise reduction device of this application.
Figure 6:
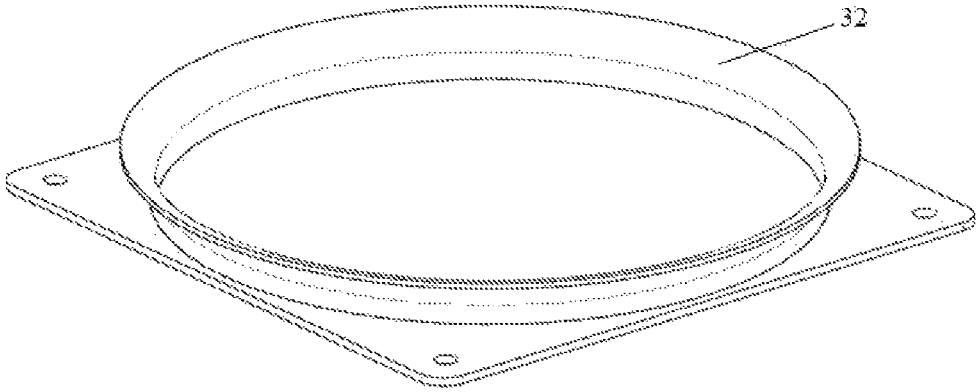
FIG. 6 is a schematic view of a horn-shaped air inlet of a noise reduction device of this application.

As shown in FIGS. 5 and 6, on the basis of Embodiment 1, a microporous structure 31 is added to the inner wall of the short tube flow guide cover 3, and a horn-shaped air inlet 32 is added when the flow guide cover is installed in an upstream through-flow area of the heat dissipation fan 1, which can also suppress broadband noise in a certain range. According to the principle of micropores, the thickness of the microporous structure is no more than 1 mm, the pore size is no more than 1 mm, and the perforation percentage is 1%-3%. The horn-shaped air inlet 32 and the short tube flow guide cover 3 can be integrated or spliced, and the splicing place is smooth and flat.

Embodiment 3

Figure 10:
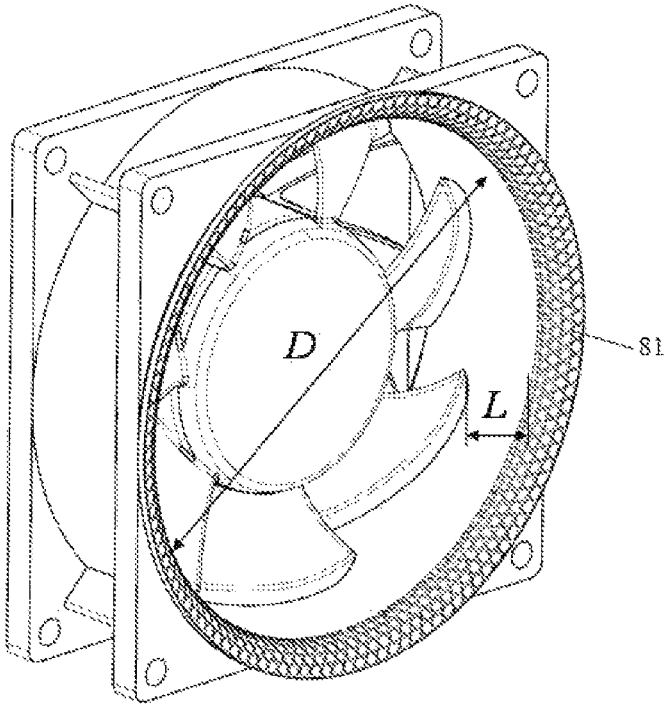
FIG. 10 is a schematic view of a recessed structure of the outer frame of a fan of this application.

On the basis of Embodiment 1, a recessed structure may be provided on the inner wall of the short tube flow guide cover 3, and the recessed structure may refer to a recessed structure 81 shown in FIG. 10. Compared with a smooth wall surface, the wall surface with the recessed structure 81 can change the flow separation state of intake fluid and reduce the turbulence of intake air, thereby realizing the noise reduction of discrete and broadband noise. The recessed structure 9 can be a partially ellipsoid shape formed by hollowing out the inner wall.

Embodiment 4

In this embodiment, the application of multiple heat dissipation fans 1 connected in series and parallel does not change the principle and action mode of the duct cutoff. This application can also be applied to complex fan arrangements. It should be noted that the structural strength is ensured after installation, and the natural frequency avoids the blade passing frequency and harmonic frequencies to avoid resonance.

Embodiment 5

The noise reduction device in Embodiments 1 to 3 is formed from a duct part which is formed by adding an additional part to the heat dissipation fan, and the duct part may be an independent part separated from the heat dissipation fan. However, this embodiment provides an example in which a noise reduction device is directly formed on the outer frame of the heat dissipation fan.

Figure 8:
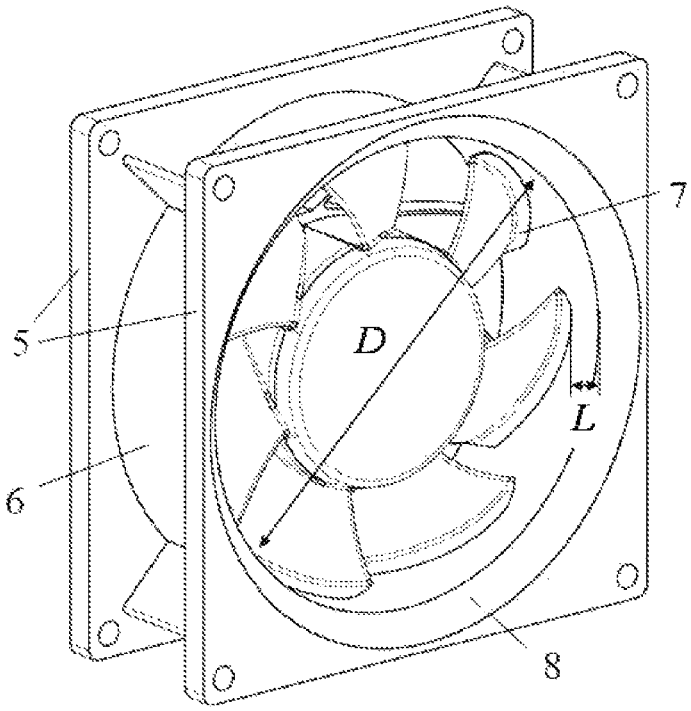
FIG. 8 is a schematic view of a three-dimensional structure of the outer frame of a fan of this application.

As shown in FIG. 8, this embodiment provides a noise reduction device for suppressing the noise of the heat dissipation fan, and the noise reduction device is formed by the outer frame of the heat dissipation fan itself. Specifically, the outer frame 5 of the fan is internally provided with a flow channel end wall 6, which constitutes a through-flow area of the heat dissipation fan, and fan blades 7 are provided inside the flow channel end wall 6. The end portion of the flow channel end wall 6 located at the upstream of the through-flow area of the heat dissipation fan extends outward from the fan blades to form a cylindrical structure. The distance of the cylindrical structure beyond the fan blades 7 is L, and the inner diameter of the flow channel end wall 6 is D, which satisfies 0.08≤L/D≤0.48. In this way, the end portion of the flow channel end wall 6 extends outward to form the noise reduction device of the heat dissipation fan, and the noise reduction device is integrally formed with the outer frame 5 of the fan, thus simplifying the structure and processing manner.

The end portion of the flow channel end wall 6 located at the upstream of the through-flow area of the heat dissipation fan is set as a horn mouth 8, which improves the air intake effect and helps to reduce noise.

Embodiment 6

Figure 9:
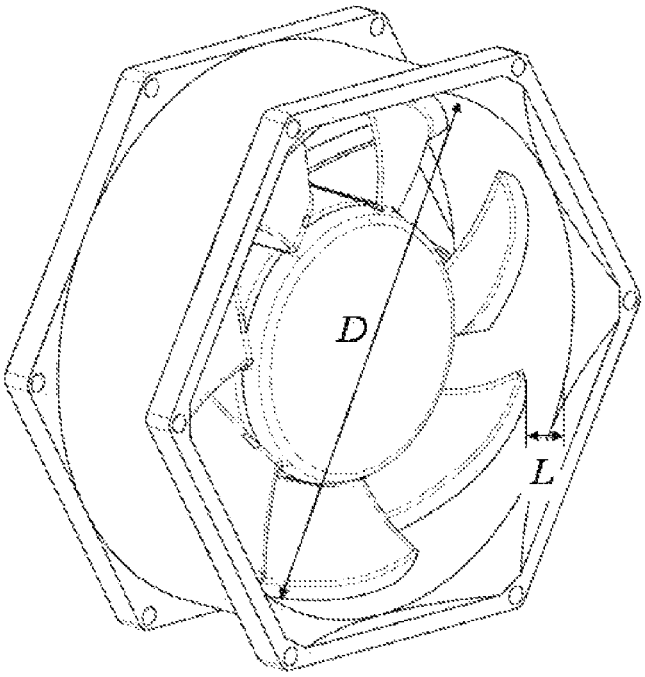
FIG. 9 is a schematic view of the outer frame of a regular hexagonal fan of this application.

This embodiment is an improvement on the basis of Embodiment 5. As shown in FIG. 9, compared with Embodiment 5, this embodiment differs in that the outer frame 5 of the fan has a regular hexagonal structure. Under the same through-flow diameter, the regular hexagonal frame saves more installation area than the square frame. In a limited space, when the fans are connected in parallel, the number of fans in parallel can be increased and the rotation speed of the fan can be reduced, thus maintaining the noise reduction under the same air volume.

Embodiment 7

This embodiment is an improvement on the basis of Embodiment 5. As shown in FIG. 10, compared with Embodiment 5, in this embodiment the end portion of the flow channel end wall 6 protrudes from the outer frame 5 of the fan, and the recessed structure 81 is provided in an area where the end portion of the flow channel end wall 6 located at the upstream of the through-flow area of the heat dissipation fan exceeds the fan blades. Compared with a smooth wall surface, the wall surface with the recessed structure 81 can change the flow separation state of intake fluid and reduce the turbulence of intake air, thereby realizing the noise reduction of discrete and broadband noise.

Preferred specific embodiments of this application are described in detail above. It should be understood that, a person of ordinary skill in the art can make various modifications and variations according to the concept of this application without creative efforts. Therefore, all technical solutions that can be obtained by those skilled in the art through logical analysis, reasoning or limited experiments based on the concept of the present application and the prior art should fall within the scope of protection defined by the claims.

The invention claimed is:

1. A noise reduction device for heat dissipation fans, the noise reduction device being applied to a heat dissipation fan with an interference structure for rotor and stator blades, wherein the noise reduction device comprises a duct formed at an end portion of a through-flow area of the heat dissipation fan, an inner diameter D of the duct is determined by a size and a rotation speed of the heat dissipation fan, and an axial length L of the duct is determined by an acoustic cutoff condition of the heat dissipation fan; wherein the axial length L and the inner diameter D of the duct satisfy $0.08 \leq L/D \leq 0.48$.

2. The noise reduction device for heat dissipation fans of claim 1, wherein the inner diameter D of the duct is greater than or equal to a diameter of the through-flow area of the heat dissipation fan, and the inner diameter D of the duct is less than or equal to an outer frame size of the heat dissipation fan.

3. The noise reduction device for heat dissipation fans of claim 1, wherein the duct is a flow guide cover in a cylindrical shape, one end of the flow guide cover is connected to a fixing bracket, and the fixing bracket is connected to the outer frame of the heat dissipation fan.

4. The noise reduction device for heat dissipation fans of claim 3, wherein the inner wall of the flow guide cover is provided with a microporous structure.

5. The noise reduction device for heat dissipation fans of claim 4, wherein a pore size and a porosity of the microporous structure are determined by a noise frequency of the heat dissipation fan.

6. The noise reduction device for heat dissipation fans of claim 5, wherein the pore size of the microporous structure is no more than 1 mm, and the porosity is 1%-3%.

7. The noise reduction device for heat dissipation fans of claim 3, wherein the inner wall of the flow guide cover is provided with a recessed structure.

8. The noise reduction device for heat dissipation fans of claim 7, wherein the recessed structure is a partially ellipsoid shape formed by hollowing out the inner wall.

9. The noise reduction device for heat dissipation fans of claim 3, wherein a horn-shaped air inlet is provided at an end portion of the flow guide cover far away from the fixing bracket.

10. The noise reduction device for heat dissipation fans of claim 9, wherein the horn-shaped air inlet and the flow guide cover are formed integrally.

11. The noise reduction device for heat dissipation fans of claim 9, wherein the horn-shaped air inlet and the flow guide cover are spliced in a split manner, and a splicing place is flat and smooth.

12. The noise reduction device for heat dissipation fans of claim 1, wherein the noise reduction device is formed from a cylindrical structure which is formed by extending a flow channel end wall provided inside the outer frame of the heat dissipation fan outwards, a distance of the cylindrical structure beyond the blades of the heat dissipation fan is L, and the inner diameter of the cylindrical structure is D, where $0.08 \leq L/D \leq 0.48$.

13. The noise reduction device for heat dissipation fans of claim 12, wherein an end portion of the cylindrical structure is provided with a horn mouth.

14. The noise reduction device for heat dissipation fans of claim 13, wherein an inner wall of the horn mouth is provided with a recessed structure.

15. The noise reduction device for heat dissipation fans of claim 12, wherein the outer frame is a regular hexagon.

* * * * *